US006892921B2

(12) United States Patent
Beville

(10) Patent No.: US 6,892,921 B2
(45) Date of Patent: May 17, 2005

(54) APPARATUS AND METHOD TO INDICATE REQUIRED COMPRESSOR PRESSURE FOR USE WITH PNEUMATIC TOOL DEVICE

(75) Inventor: John M. Beville, Jackson, TN (US)

(73) Assignee: Porter-Cable Corporation, Jackson, TN (US)

( * ) Notice: Subject to any disclaimer, the term of this patent is extended or adjusted under 35 U.S.C. 154(b) by 52 days.

(21) Appl. No.: 10/643,040

(22) Filed: Aug. 18, 2003

(65) Prior Publication Data

US 2004/0084500 A1 May 6, 2004

Related U.S. Application Data

(60) Provisional application No. 60/422,378, filed on Oct. 30, 2002.

(51) Int. Cl.[7] ..... B25C 5/02

(52) U.S. Cl. ..... 227/109; 227/120; 227/130; 227/156

(58) Field of Search ..... 227/109, 120, 227/130, 136, 156; 173/20, 21

(56) References Cited

U.S. PATENT DOCUMENTS

| | | | | | |
|---|---|---|---|---|---|
| 2,973,519 | A | * | 3/1961 | Jopp | 227/128 |
| 4,715,522 | A | * | 12/1987 | Jordan | 227/156 |
| 4,763,824 | A | * | 8/1988 | Ebihara | 227/120 |
| 4,834,278 | A | * | 5/1989 | Lin | 227/7 |
| 5,639,007 | A | * | 6/1997 | Nakamura | 227/109 |
| 6,176,412 | B1 | * | 1/2001 | Weinger et al. | 227/142 |
| 6,604,666 | B1 | * | 8/2003 | Pedicini et al. | 227/131 |
| 6,641,021 | B2 | * | 11/2003 | Jablonski | 227/120 |
| 6,651,862 | B2 | * | 11/2003 | Driscoll et al. | 227/123 |

* cited by examiner

*Primary Examiner*—Scott A. Smith
(74) *Attorney, Agent, or Firm*—Suiter West PC LLO

(57) ABSTRACT

An apparatus which enables a user of a pneumatic tool device, such as a nail gun, to determine the required compressor pressure needed to most effectively utilize the pneumatic tool device and maximize the life of the tool. A compressor pressure indication assembly on a nail gun comprising a nail verification assembly and a readout assembly enables a user to verify the length and/or diameter of the nails to be driven by the nail gun and set the compressor pressure accordingly.

37 Claims, 4 Drawing Sheets

APPARATUS AND METHOD TO INDICATE REQUIRED COMPRESSOR PRESSURE FOR USE WITH PNEUMATIC TOOL DEVICE

CROSS REFERENCE TO RELATED APPLICATION

The present application claims priority under 35 U.S.C. §119 to the U.S. Provisional Application Ser. No. 60/422,378 filed on Oct. 30, 2002 which is herein incorporated by reference in its entirety.

FIELD OF THE INVENTION

The present invention generally relates to the field of pneumatic tool devices, and particularly to an apparatus and method for indicating the required compressor pressure to be used when operating a pneumatic tool, such as a pneumatic nail gun.

BACKGROUND OF THE INVENTION

The use of air driven tools is commonplace in a variety of construction situations. Pneumatic nail guns have greatly increased efficiency and productivity on construction worksites. However, nail guns which employ air pressure (pneumatic nail guns) to drive nails have a limited life span due to the high pressures involved in their use. This may result in inefficient tool functionality which may increase labor time and construction costs. Further, this limited life span may result in lost time when the tool must be replaced.

Unfortunately, there is little in the way of help to a user of these pneumatic nail guns for avoiding shortening the life span of the nail gun due to improper compressor pressure use. For example, nails may have varying lengths and widths. To effectively drive one nail may require a different compressor pressure than that required to effectively drive another. If the user is unaware of the difference in the nails then the compressor pressure will not be adjusted to maximize tool effectiveness. This may result in increased wear on the tool which will shorten its useful life. While it is known to provide a system of adjusting compressor pressure in correlation with nail size when the user is aware of the nail size, there is no protection against the unaware user or the user of a nail gun when the nails have been previously loaded into the nail gun and the user is unable to determine the nail size. In these situations use of the nail gun may significantly decrease the useful life of the nail gun.

Therefore, it would be desirable to provide a way to maximize the useful life of a pneumatic device, such as a pneumatic nail gun, while ensuring effective nail gun use.

SUMMARY OF THE INVENTION

Accordingly, the present invention is directed to an apparatus and method of indicating the required compressor pressure for use with a pneumatic nail gun. In a first aspect of the present invention, a compressor pressure indication assembly for a pneumatic nail gun having a nail loading assembly comprises a nail verification assembly disposed on the nail loading assembly for identifying the length of a nail received in the nail loading assembly. A readout assembly is associated with the nail verification assembly and provides information to an operator of the pneumatic nail gun. Wherein, the compressor pressure indication assembly indicates the required compressor pressure when using the pneumatic nail gun.

In a second aspect of the present invention, a compressor pressure indication assembly for a pneumatic nail gun having a nail loading assembly comprises a nail verification assembly disposed on the nail loading assembly for identifying the diameter of a nail received in the nail loading assembly. A readout assembly is associated with the nail verification assembly and provides information to an operator of the pneumatic nail gun. Wherein, the compressor pressure indication assembly indicates the required compressor pressure when using the pneumatic nail gun. In a third aspect of the present invention, a compressor pressure indication assembly for a pneumatic nail gun having a nail loading assembly comprises a nail verification assembly disposed on the nail loading assembly for identifying the length and diameter of a nail received in the nail loading assembly. A readout assembly is associated with the nail verification assembly and provides information to an operator of the pneumatic nail gun. Wherein, the compressor pressure indication assembly indicates the required compressor pressure when using the pneumatic nail gun.

In a fourth aspect of the present invention, a nail loading assembly for a pneumatic nail gun coupled with a compressor comprises a housing coupled with a compressor pressure indication assembly. The compressor pressure indication assembly for identifying the length and diameter of the nail stored in the housing and indicating the required compressor pressure for use with the pneumatic nail gun based on the identified nail length and diameter.

In a fifth aspect of the present invention, a pneumatic nail gun assembly comprises a housing disposed with a handle, the handle being coupled with a compressor. Further, the pneumatic nail gun assembly comprises a nail driving assembly coupled with the housing, the nail driving assembly being suitable for driving a nail. Additionally, a nail loading assembly is coupled with the nail driving assembly, the nail loading assembly being suitable for storing the nail and providing the nail to the nail driving assembly. A compressor pressure indication assembly is disposed on the nail loading assembly, the compressor pressure indication assembly being suitable for identifying the length and diameter of the nail stored in the nail loading assembly. Thus, the compressor pressure indication assembly indicates the required compressor pressure when using the pneumatic nail gun assembly based on the identified length and diameter of the nail.

In a sixth aspect of the present invention, a method for indicating the required compressor pressure when using a nail gun coupled with a compressor comprises loading a nail into a nail loading assembly, the nail loading assembly being coupled with the nail gun. Identifying the length and diameter of the nail in the nail loading assembly and correlating the compressor pressure with the identified nail length and diameter.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 5, exemplary embodiments of the present invention are shown. The present invention increases the effectiveness and useful life of a pneumatic nail gun through indication of proper compressor pressure correlated to the specific instrument being operated upon by the tool. An operator of the present invention is assured of an accurate indication of correct compressor pressure without requiring the user to remove already loaded instruments (e.g., nail magazine) from the pneumatic tool.

Figure 1:
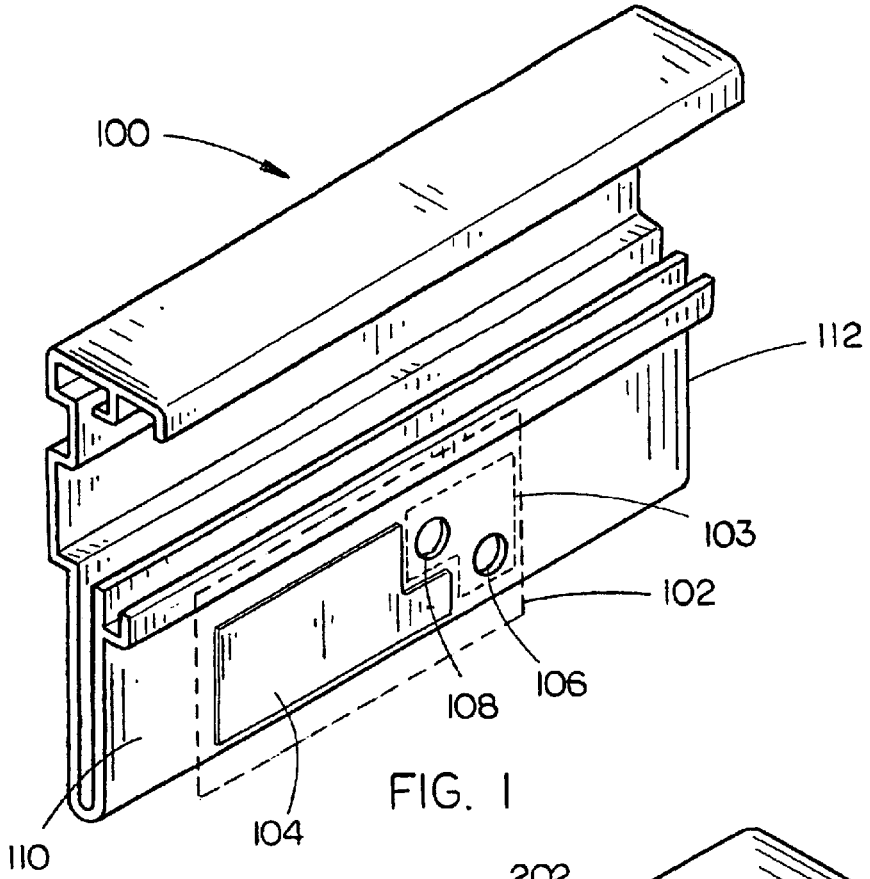
FIG. 1 is a partial isometric view of the nail magazine of a pneumatic nail gun, illustrating a compressor pressure indication assembly in accordance with an exemplary embodiment of the present invention.

In a preferred embodiment, shown in FIG. 1, a housing 100 is provided with a compressor pressure indication assembly 102 in accordance with the present invention. The compressor pressure indication assembly 102 includes a readout assembly 104 and a nail verification assembly 103. Preferably, the nail verification assembly 103 comprises a first nail inspection station 106 and a second nail inspection station 108. The first and second nail inspection stations 106 and 108 are disposed on a first side 110 of a housing 100, proximally located towards a first end 112 of the housing 100. The first end 112 allows for the loading of nails into the housing 100.

In the present embodiment the first and second nail inspection station 106 and 108 allow visual identification of the nail loaded into the housing. The visual identification of the nail in the first and second nail inspection stations 106 and 108 provide a visual method of nail length and nail shank diameter identification. Preferably, the first and second nail inspection station 106 and 108 are a first and second aperture. Alternatively, the first and second inspection station 106 and 108 may comprise a horizontally aligned slat or a vertically aligned slot. It is contemplated that other systems and methods of identifying nail length within the housing 100 may be employed, such as electrical sensor systems, optical sensor systems, and the like. It is further contemplated that, in alternative embodiments, the first and second nail inspection station 106 and 108 may allow visual identification of only the nail length or nail shank diameter.

The size of the first and second nail inspection stations 106 and 108 are of a suitable dimension to allow for the visual identification of the position of the nail relative to the aperture. This, in turn, allows for the identification of the length and diameter of the nail being placed into the housing 100. Preferably, aperture diameters may vary from one-sixteenth of an inch to one-half an inch. In the exemplary embodiment the aperture diameter is one-eighth of an inch. It is understood that the aperture diameter is not limited by the example and ranges stated here but may be smaller than or greater than the stated diameter sizes without departing from the scope and spirit of the present invention. Further, in the present embodiment the first and second nail inspection stations 106 and 108 are only provided in the first side 110. Alternatively, the first and second nail inspection stations 106 and 108 may be located on a second side of the housing 100 or the apertures may be disposed on both the first and second side of the housing.

In the current embodiment, the first nail inspection station 106 is located closer to the first end 112, relative to the second nail inspection station 108. The second nail inspection station 108 is spaced apart from the first nail inspection station 106 to allow for the second nail inspection station 108 to provide an independent identification of the nail. Further, the second nail inspection station 108 is positioned at an angle relative to the first nail inspection station 106. The angle of positioning of the second nail inspection station 108 may provide an advantage to a user of the present invention if the nails being used are not of sufficient length to be viewed in the first nail inspection station 106. The amount of spacing between and relative angle of the first and second nail inspection station 106 and 108 may be varied as contemplated by one of ordinary skill in the art.

Alternatively, the nail verification assembly 103 may comprise a single nail inspection station disposed in the housing 100. The single nail inspection station may be of sufficient length and size to ascertain the length and diameter of a variety of nail configurations. It is contemplated that the nail inspection station may employ three or more apertures to provide verification of nail length and diameter for ascertainment of appropriate compressor pressure. It is further contemplated that the nail inspection station, whether employing one, two, three or more apertures, may include nail length markers and nail diameter markers proximally disposed about the aperture(s). The nail length and diameter markers may comprise a line mark next to an aperture where the tip and outside edges of the nail observed in the aperture is correlated to the line mark, which in turn indicates to an operator the required compressor pressure.

In the preferred embodiment, the readout assembly 104 is a label, which contains printed terms identifying the required compressor pressure in correlation to the nail length and the nail shank diameter identified by the first and second nail inspection stations 106 and 108. For example, the chart may contain short phrases, such as "tip of nail visible", "shank of nail visible", "diameter of nail outside markings", or "diameter of nail inside markings," and then have the corresponding compressor pressures indicated. It is understood that the readout assembly 104 may indicate a range of compressor pressures suitable for use with a particular nail length and/or diameter. Alternatively, the readout assembly 104 may be a chart, which on one side identifies the nail length and/or diameter and on the other side gives the corresponding compressor pressure. It is further contemplated that the readout assembly 104 may provide an indication of required compressor pressure based only on the identified nail length or based only on the identified diameter of the nail shank.

In the present embodiment, the readout assembly 104 is located proximally to the first and second nail inspection stations 106 and 108. Alternatively, the location of the readout assembly 104 may be varied. For instance, the readout assembly 104 may be disposed at various locations along the housing 100, not necessarily proximal to the nail inspection station. It is contemplated that the readout assembly 104 may be disposed in various locations upon a nail gun which is employing the compressor pressure indication assembly 102 of the present invention. For example, a section of the handle of the nail gun may be disposed with the readout assembly 104 or on a nail driving assembly housing of the nail gun.

It is further contemplated that the readout assembly 104 may be disposed upon an object or surface, which is not the housing 102 or the nail gun as described above. For example, the readout assembly 104 may be contained within the pages of an instruction manual for the operation of a device with which the compressor pressure indication assembly 102 is being utilized. Alternatively, the readout assembly 104 may be disposed upon a casing within which is stored a device with which the compressor pressure indication assembly 102 is being utilized. For example, a nail gun may be sold in a casing upon which the readout assembly 104 is disposed.

In the current embodiment, the readout assembly 104 is an "L" shaped label adhered to the first side 110 of the housing 100. It is understood that the shape of the readout assembly 104 may vary as contemplated by one of ordinary skill in the art. The adhering may be accomplished by numerous methods, such as, glue, tape, and the like. It is contemplated that the readout assembly 104 may be positioned on the housing 100 by a variety of methods. For example, the readout assembly 104 may be engraved on the first side 110 of the housing 100. Alternatively, the readout assembly 104 may be magnetically attached to the housing 100. It is understood that the readout assembly 104 may be a removable assembly, thereby, being enabled for use with multiple housing structures.

It is contemplated that the readout assembly 104 may be an information handling system which is enabled to provide correlation of the nail length identified with a required compressor pressure. For example, an operator of the compressor pressure indication assembly 102 first identifies the nail length and/or diameter through use of the nail verification assembly 103. The operator then enters the information into the readout assembly 104, which processes the information to determine the necessary compressor pressure. The readout assembly 104 may further comprise a display. The display provides a visual readout of relevant information to the operator such as the required compressor pressure setting correlating to the nail length and/or diameter information entered by the operator. The readout assembly may provide a range of compressor pressures suitable for use with the identified nail length and/or diameter and display that range on the display.

As an information handling system, the readout assembly 104 may be a computing system enabled with computing functionality. For example, the readout assembly 104 may be enabled to allow an operator to perform calculations or store relevant information. Additionally, the readout assembly 104 may be enabled to communicatively link with peripheral computing devices. Such communicative linkage may be established using a variety of methods, such as serial cable, infrared, radio frequency, and the like. The communicative linkages may form a network which may download information into a central computing system, which information may then be reviewed by an operator. This may be advantageous at a worksite as a supervisor may be able to track the type and number of nails being used by the operators of the nail guns linked into the network.

Figure 2:
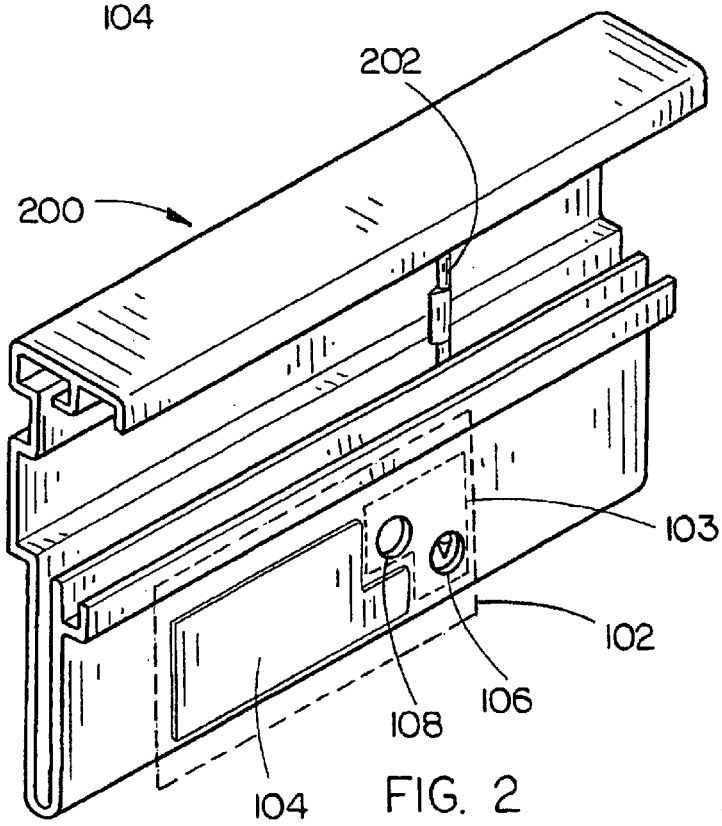
FIG. 2 is an illustration of the compressor pressure indication assembly engaged with a nail in a first nail inspection station and a readout assembly indicating a first required compressor pressure.

Referring now to FIG. 2, the compressor pressure indication assembly 102 is shown disposed on a nail loading assembly 200 and engaged with a nail 202. In FIG. 2, the nail 202 is located in a first position, visible through the first nail inspection station 106. The part of the nail 202 that is visible is indicative of the overall nail length which provides the guidance as to the required compressor pressure. The first nail inspection station 106 also provides the user of the compressor pressure indication assembly 102 with the ability to determine the diameter of the nail shank which provides further guidance as to the required compressor pressure. In the present embodiment, the tip of the nail 202 is visible in the first nail inspection station 106. From this visual indication, the operator of the present invention may then utilize the readout assembly 104 to determine the required compressor pressure or range of compressor pressures within which safe operation may be accomplished. For instance, if the readout assembly 104 uses the phrase "tip of nail visible and nail diameter outside markings" with a corresponding compressor pressure or range of compressor pressures, then the operator, upon visually determining that the tip of the nail is visible and that the nail diameter is outside the markings would set the compressor pressure to that indicated by the readout assembly 104.

Figure 3:
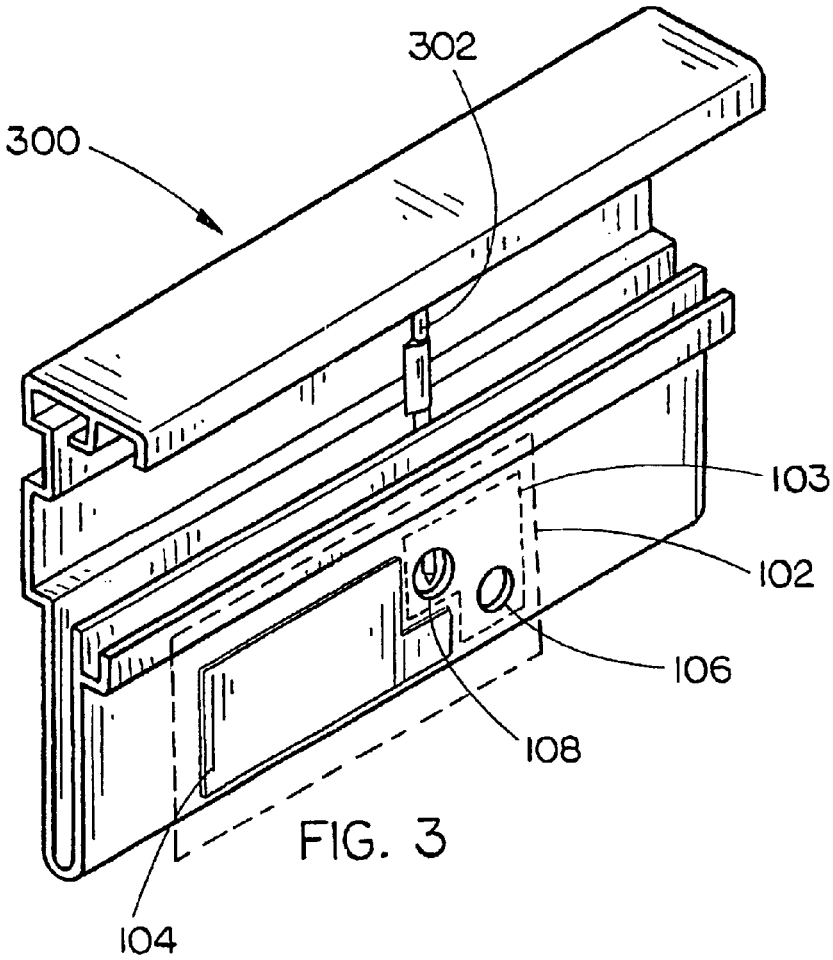
FIG. 3 is an illustration of the compressor pressure indication assembly engaged with a nail in a second nail inspection station and the readout assembly indicating a second required compressor pressure.

In FIG. 3 the compressor pressure indication assembly 102 is shown disposed on a nail loading assembly 300 and engaged with a nail 302. The nail 302 is located in a second position, visible through the second nail inspection station 108. In this location it may be seen that the tip of the nail is visible through the second nail inspection station 108. The second nail inspection station 108 also enables a nail shank diameter determination. From this visible identification, the readout assembly 104 may instruct the operator that a new compressor pressure setting or range of compressor pressure is required on the compressor for use with the current nail. In the exemplary embodiment shown, the compressor pressure may need to be set to a lower pressure setting as the nail length is shorter than that seen in FIG. 2. The diameter of the nail may be the same as that seen in FIG. 2 or different from that in FIG. 2 requiring adjustment of the compressor pressure based on the new nail shank diameter. It is understood that the readout assembly 104 provides a variety of readings. Thus, when a nail is engaged in the second nail inspection station 108, the readout assembly 104 may instruct the operator to adjust the pressure setting higher or lower than where it is currently set.

Figure 4:
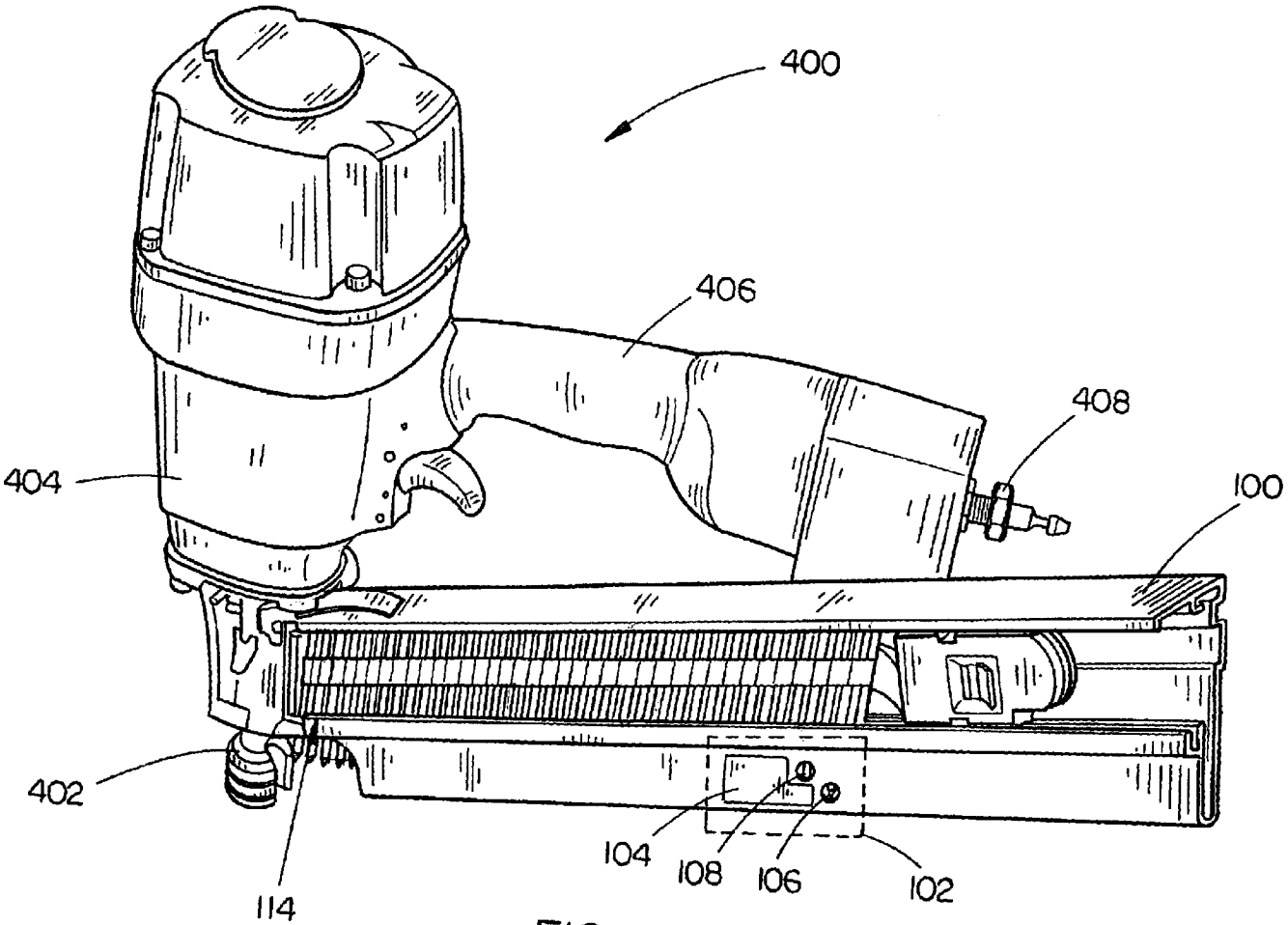
FIG. 4 is an isometric view of a pneumatic nail gun including the compressor pressure indication assembly in accordance with an exemplary embodiment of the present invention.

Referring now to FIG. 4, a pneumatic nail gun 400 is shown disposed with the compressor pressure indication assembly 102 including the readout assembly 104. In the current embodiment a second end 114 of housing 100 connects with a nose casting 402. The nose casting 402 is connected to a nail gun casing 404, the nail gun casing 404 is disposed with a handle 406 and includes a driver blade assembly for driving the nail presented in the nose casting 402. The handle 406 is disposed with a connection assembly 408 for connecting with a hose, which connects with an air compressor.

It is contemplated that the compressor pressure indication assembly 102 may be disposed on an adjustable angle nail gun magazine for use with a pneumatic nail gun. The positioning of the first and second nail inspection stations 106 and 108 on the adjustable angle nail gun magazine may be adjusted to accommodate the multi-position functionality of the adjustable angle nail gun magazine.

Figure 5:
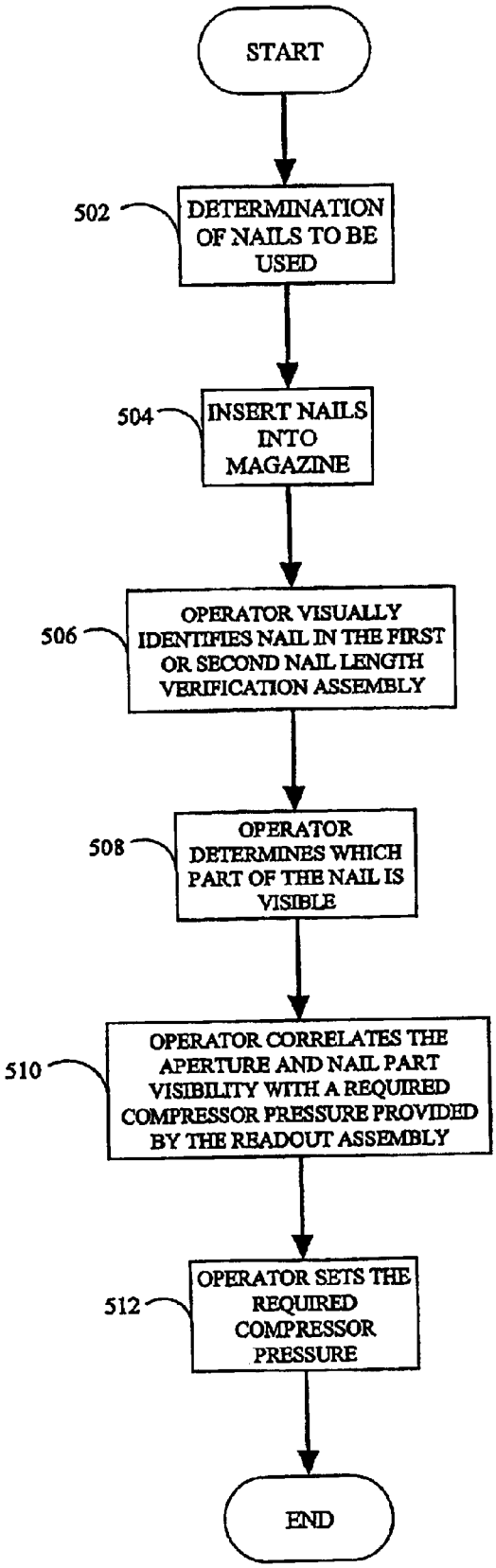
FIG. 5 is a flowchart illustrating a method for indicating the required compressor pressure when using a nail gun coupled with a compressor.

A flowchart illustrating the functional steps accomplished utilizing the present invention is shown in FIG. 5. In step 502 an operator determines what nails are to be used during operation of the pneumatic nail gun. Generally, there are two types of nails used with these nail guns, clipped-head and round-head, and both types of nails come in a magazine of multiple nails which are bound together. Depending on which type of nail is chosen, an angle of nail presentation is determined by the collation angle of the nail magazine. In step 504 the operator begins to insert the magazine of nails into the housing. As the magazine is being loaded, in step 506, the operator visually identifies the nail either within the first nail inspection station 106 or the second nail inspection station 108. In step 508 the operator determines which part of the nail is visible and the diameter of the nail shank. After determining the aperture through which the nail is viewed, which part of the nail is visible, and the diameter of the nail shank, in step 510 the operator correlates the aperture, nail part visibility, and nail shank diameter with a required compressor pressure provided by the readout assembly. In step 512 the operator sets the compressor pressure to the required pressure and begins operation of the nail gun. This method ensures maximum effectiveness of the nail gun when driving each nail and maximizes the useful life of the nail gun.

In the exemplary embodiments, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method may be rearranged while remaining within the scope and spirit of the present invention. The accompanying method claims present elements of the various steps in a sample order, and are not necessarily meant to be limited to the specific order or hierarchy presented.

It is believed that the apparatus and method to indicate required compressor pressure to a user of a nail gun of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A compressor pressure indication assembly for a pneumatic nail gun having a nail loading assembly, comprising:

a nail verification assembly disposed in the nail loading assembly of the pneumatic nail gun, the nail verification assembly provides indication of the length of a nail received in the nail loading assembly; and a readout assembly associated with the nail verification assembly, the readout assembly providing a display of information, wherein the compressor pressure indication assembly indicates the required compressor pressure when using the pneumatic nail gun.

2. The compressor pressure indication assembly of claim 1, wherein the nail loading assembly is a nail gun magazine.

3. The compressor pressure indication assembly of claim 1, wherein the nail verification assembly comprises a nail inspection station disposed in the nail loading assembly of the pneumatic nail gun.

4. The compressor pressure indication assembly of claim 3, wherein the nail inspection station is selected from the group consisting of an aperture, a horizontally aligned slate, or a vertically aligned slot.

5. The compressor pressure indication assembly of claim 3, wherein the nail verification assembly comprises a first aperture and a second aperture disposed in the nail loading assembly of the pneumatic nail gun.

6. The compressor pressure indication assembly of claim 1, wherein the readout assembly is disposed on the nail loading assembly of the pneumatic nail gun and proximally located by the nail verification assembly.

7. A compressor pressure indication assembly for a pneumatic nail gun having a nail loading assembly, comprising:

a nail verification assembly disposed in the nail loading assembly of the pneumatic nail gun, the nail verification assembly provides indication of a diameter of a nail received in the nail loading assembly; and a readout assembly associated with the nail verification assembly, the readout assembly providing a display of information, wherein the compressor pressure indication assembly indicates the required compressor pressure when using the pneumatic nail gun.

8. The compressor pressure indication assembly of claim 7, wherein the nail loading assembly is a nail gun magazine.

9. The compressor pressure indication assembly of claim 7, wherein the nail verification assembly comprises a nail inspection station disposed in the nail loading assembly of the pneumatic nail gun.

10. The compressor pressure indication assembly of claim 9, wherein the nail inspection station is selected from the group consisting of an aperture, a horizontally aligned slate, or a vertically aligned slot.

11. The compressor pressure indication assembly of claim 9, wherein the nail verification assembly comprises a first aperture and a second aperture disposed in the nail loading assembly of the pneumatic nail gun.

12. The compressor pressure indication assembly of claim 7, wherein the readout assembly is disposed on the nail loading assembly of the pneumatic nail gun and proximally located by the nail verification assembly.

13. A compressor pressure indication assembly for a pneumatic nail gun having a nail loading assembly, comprising:

a nail verification assembly disposed in the nail loading assembly of the pneumatic nail gun, the nail verification assembly provides indication of a length and a diameter of a nail received in the nail loading assembly; and a readout assembly associated with the nail verification assembly, the readout assembly providing a display of information, wherein the compressor pressure indication assembly indicates the required compressor pressure when using the pneumatic nail gun.

14. The compressor pressure indication assembly of claim 13, wherein the nail loading assembly is a nail gun magazine.

15. The compressor pressure indication assembly of claim 13, wherein the nail verification assembly comprises a nail inspection station disposed in the nail loading assembly of the pneumatic nail gun.

16. The compressor pressure indication assembly of claim 15, wherein the nail inspection station is selected from the group consisting of an aperture, a horizontally aligned slate, or a vertically aligned slot.

17. The compressor pressure indication assembly of claim 15, wherein the nail verification assembly comprises a first aperture and a second aperture disposed in the nail loading assembly of the pneumatic nail gun.

18. The compressor pressure indication assembly of claim 13, wherein the readout assembly is disposed on the nail loading assembly of the pneumatic nail gun and proximally located by the nail verification assembly.

19. A nail loading assembly for a pneumatic nail gun coupled with a compressor, comprising:

a housing for storing a nail and providing the nail to the pneumatic nail gun; and a compressor pressure indication assembly disposed on the housing, the compressor pressure indication assembly for identifying the length of the nail stored in the housing, wherein the compressor pressure indication assembly indicates the required compressor pressure for use with the pneumatic nail gun based on the identified nail length.

20. The nail loading assembly of claim 19, wherein the compressor pressure indication assembly further comprises:

a nail verification assembly for identifying the length of a nail in the nail loading assembly; and a readout assembly for indicating the required compressor pressure for the identified nail length.

21. The nail loading assembly of claim 20, wherein the nail verification assembly comprises a nail inspection station selected from the group consisting of an aperture, a horizontally aligned slate, or a vertically aligned slot.

22. The nail loading assembly of claim 20, wherein the nail verification assembly comprises a first aperture and a second aperture disposed in the nail loading assembly of the pneumatic nail gun.

23. The nail loading assembly of claim 20, wherein the readout assembly is disposed on the nail loading assembly of the pneumatic nail gun and proximally located by the nail verification assembly.

24. The nail loading assembly of claim 19, wherein the housing is a nail gun magazine.

25. A pneumatic nail gun assembly, comprising:

a housing disposed with a handle, the handle being coupled with a compressor;

a nail driving assembly coupled with the housing, the nail driving assembly for driving a nail;

a nail loading assembly coupled with the nail driving assembly, the nail loading assembly for receiving the nail; and a compressor pressure indication assembly disposed on the nail loading assembly, the compressor pressure indication assembly for identifying the length and diameter of the nail stored in the nail loading assembly, wherein the compressor pressure indication assembly indicates the required compressor pressure when using the pneumatic nail gun assembly based on the identified length and diameter of the nail.

26. The pneumatic nail gun assembly of claim 25, wherein the compressor pressure indication assembly further comprises:

a nail verification assembly for identifying the length of a nail in the nail loading assembly; and a readout assembly for indicating the required compressor pressure for the identified nail length.

27. The pneumatic nail gun assembly of claim 26, wherein the nail verification assembly comprises a nail inspection station selected from the group consisting of an aperture, a horizontally aligned slate, or a vertically aligned slot.

28. The pneumatic nail gun assembly of claim 26, wherein the nail verification assembly comprises a first aperture and a second aperture disposed in the nail loading assembly of the pneumatic nail gun.

29. The pneumatic nail gun indication assembly of claim 26, wherein the readout assembly is disposed on the nail loading assembly of the pneumatic nail gun and proximally located by the nail verification assembly.

30. The pneumatic nail gun assembly of claim 25, wherein the nail loading assembly is a nail gun magazine.

31. A method for indicating the required compressor pressure when using a nail gun coupled with a compressor, comprising:

loading a nail into a nail loading assembly, the nail loading assembly being coupled with the nail gun;

identifying the length and diameter of the nail in the nail loading assembly; and correlating the compressor pressure with the identified nail length.

32. The method of claim 31, wherein the nail loading assembly is a nail gun magazine coupled to the nail gun.

33. The method of claim 31, wherein the step of identifying the length of the nail is accomplished by use of a nail verification assembly.

34. The method of claim 33, wherein the nail verification assembly comprises an aperture disposed in the nail loading assembly of the pneumatic nail gun.

35. The method of claim 33, wherein the nail verification assembly comprises a first aperture and a second aperture disposed in the nail loading assembly of the pneumatic nail gun.

36. The method of claim 31, wherein the step of correlating the compressor pressure with the nail length is accomplished by use of a readout assembly.

37. The method of claim 36, wherein the readout assembly is disposed on the nail loading assembly of the pneumatic nail gun and proximally located by the nail verification assembly.

* * * * *